US005244149A

United States Patent [19]

Yuan et al.

[11] Patent Number: 5,244,149

[45] Date of Patent: Sep. 14, 1993

[54] IMPINGING JET FLUID DISTRIBUTOR

[75] Inventors: Sinh-Luh Yuan, Webster; David W. Gruszczynski, Rochester, both of N.Y.

[73] Assignee: Eastman Kodak Company, Rochester, N.Y.

[21] Appl. No.: 879,249

[22] Filed: May 5, 1992

[51] Int. Cl.[5] ..... B05B 17/00

[52] U.S. Cl. ..... 239/1; 239/545; 239/597; 239/602

[58] Field of Search ..... 239/433, 545, 597, 601, 239/590, 590.5, 592-595, 1

[56] References Cited

U.S. PATENT DOCUMENTS

| | | | |
|---|---|---|---|
| 1,540,042 | 6/1925 | Thomas | 239/597 |
| 2,770,501 | 11/1956 | Coanda | 239/545 |
| 3,675,855 | 7/1972 | Harwood et al. | 239/597 |
| 3,878,991 | 4/1975 | Sabadics et al. | 239/456 |
| 3,880,117 | 4/1975 | Stroszynski | 118/410 |
| 4,062,492 | 12/1977 | Thornton | 239/125 |
| 4,306,684 | 12/1981 | Peterson | 239/597 |
| 4,672,886 | 6/1987 | Stouffer | 239/545 |

*Primary Examiner*—Andres Kashnikow
*Assistant Examiner*—Lesley D. Morris
*Attorney, Agent, or Firm*—Carl F. Ruoff

[57] ABSTRACT

A liquid distribution device and method for distributing liquid uniformly is disclosed. A coating liquid is supplied to a distribution cavity from both sides of the cavity through a delivery line. The cavity is a slot which expands from the length at the liquid entrance of the cavity to a longer length at the cavity exit. The two streams of liquid impinge against each other inside the cavity and spread out along the contour of the cavity. This liquid distribution system eliminates recirculation regions and does not experience problems with variable residence time and distribution across the slot.

11 Claims, 6 Drawing Sheets

FIG. 9
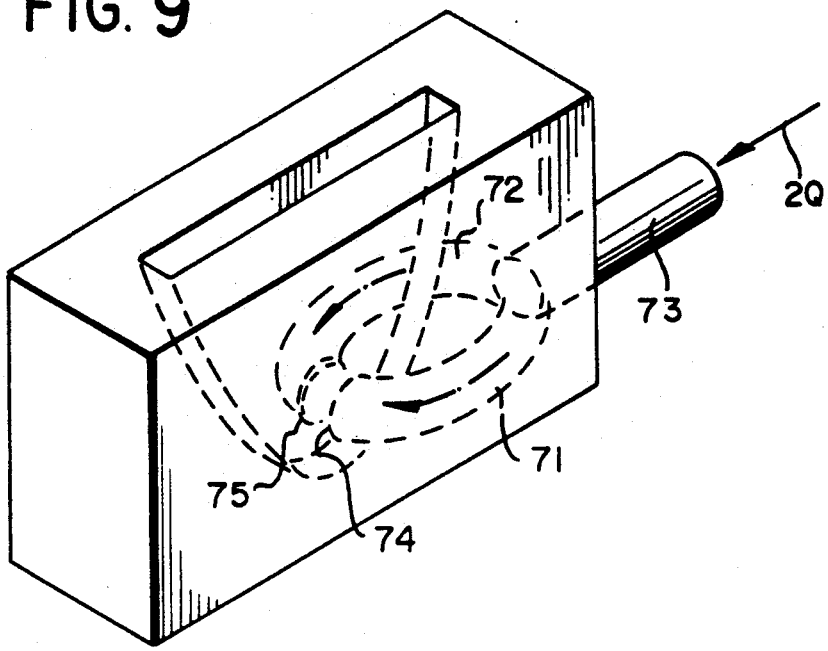
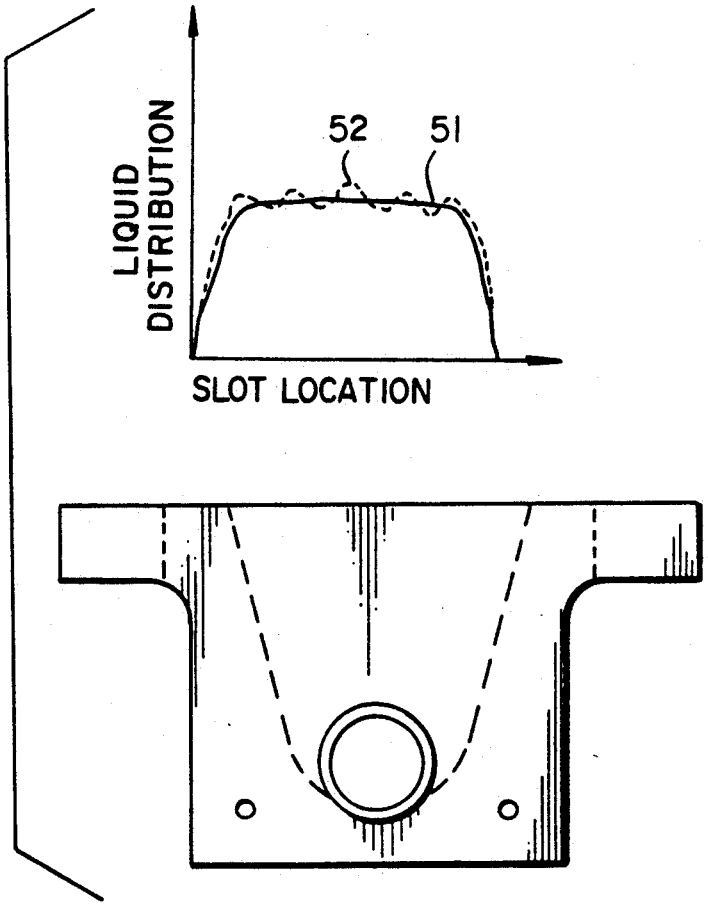
FIG. 10

IMPINGING JET FLUID DISTRIBUTOR

FIELD OF THE INVENTION

The present invention relates to a liquid distribution apparatus. Specifically, the invention is related to a coating apparatus. More specifically, the invention is related to a liquid distribution device connected externally to a coating apparatus for the manufacturing of sensitized products such as photographic film and photographic paper, or magnetic recording materials such as magnetic recording tape and magnetic video tape.

BACKGROUND INFORMATION ON THE INVENTION

Existing liquid distribution devices used in the photographic industry generally comprise a distribution nozzle, the inlet of which is usually circular in cross section and the internal passage of which tapers to an elongated slot. This distribution nozzle connects the line delivering liquid from a liquid reservoir to the actual coating device. The coating liquid is fed into the inlet duct and exits from the slot into the coating hopper. The prior art design is not ideal in that recirculation zones occur within the inlet duct and the distribution of coating liquid across the slot is not uniform.

Another problem in providing a distribution nozzle for a coating hopper is that there is a severe space limitation. In some applications, the coating hopper is located over the web so the space to provide a distribution nozzle is limited to the volume between the web and the bottom of the hopper. This problem is compounded as additional hopper elements are added for feeding coating solutions.

The present invention solves the recirculation problem and fluid distribution problem in a novel manner. In addition, the present invention provides a distribution nozzle which requires no more space beneath the hopper than prior art nozzles.

SUMMARY OF THE INVENTION

The present invention discloses a method and apparatus for uniformly distributing fluid through a slot while eliminating recirculation zones. The fluid distributor includes a channel formed by a pair of arcuate sides which are spaced apart to form an exit slot at one end. At the other end of the channel a pair of opposed conduits is provided for delivering fluid wherein the fluid impinges within the channel and flows out the exit slot. The device described eliminates recirculation zones within the channel and provides uniform distribution across the slot. The present device and method is particularly useful for distributing photographic emulsions to a coating hopper for the manufacture of photographic film and paper.

BRIEF DESCRIPTION OF THE DRAWINGS

FIG. 9 shows an alternative embodiment of the present invention. FIG. 10 shows the fluid distribution of the present invention and the liquid distribution across the exit slot.

For a better understanding of the present invention together with other objects, advantages and capabilities thereof, reference is made to the following description and appended claims in connection with the above referenced drawing.

DESCRIPTION OF PREFERRED EMBODIMENT

Figure 1:
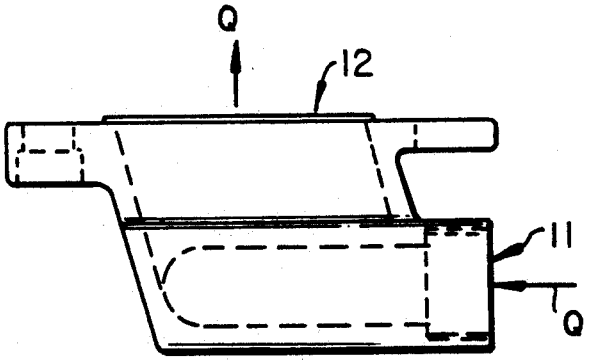
FIG. 1 PRIOR ART
FIG. 1 shows a side view of a prior art fluid distributor.
Figure 2:
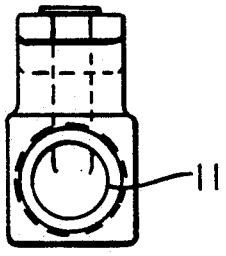
FIG. 2 PRIOR ART
FIG. 2 shows an end view of a prior art fluid distributor.
Figure 3:
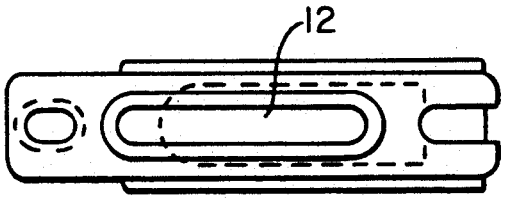
FIG. 3 PRIOR ART
FIG. 3 shows a top view of a prior art fluid distributor.

FIGS. 1–3 show a typical prior art liquid distribution device which is connected externally to a coating device (not shown). This device consists of an inlet duct 11, which usually is circular, and an exit slot 12, which usually is an elongated slot. A coating liquid Q is fed into the inlet duct and exits from the exit slot 12. This design has two undesirable features: the existence of recirculation regions and the inability to distribute liquid uniformly across the slot.

A recirculation region is a region of eddies where liquid gets trapped for a long time before it is able to leave. The locations of the recirculation regions inside the liquid distribution device are shown at locations 21 and 22 in FIG. 4. Such behavior is undesirable for the manufacturing of sensitized products such as photographic film and photographic paper, or magnetic recording materials such as magnetic recording tape and magnetic video tape since the homogenity of the coated materials may be affected by the change of their physical and chemical properties with time. Flow visualization experiments conducted with the prior art liquid distributor have shown that recirculation regions appear when the Reynolds number is as low as 50. Here the Reynolds number is defined as $\rho UD/\mu$, where $\rho$ is liquid density; U is the average speed of liquid inside the delivery line; $\mu$ is the liquid dynamic viscosity; and D is the diameter of the inlet duct. The observation of recirculation regions at such a low Reynolds number indicates that the quality of a product may be compromised if it is coated at a Reynolds number higher than 50. In view of the diversified products being made with the conventional coating process, it is desirable to have a liquid distributor which does not have recirculation regions.

Figure 4:
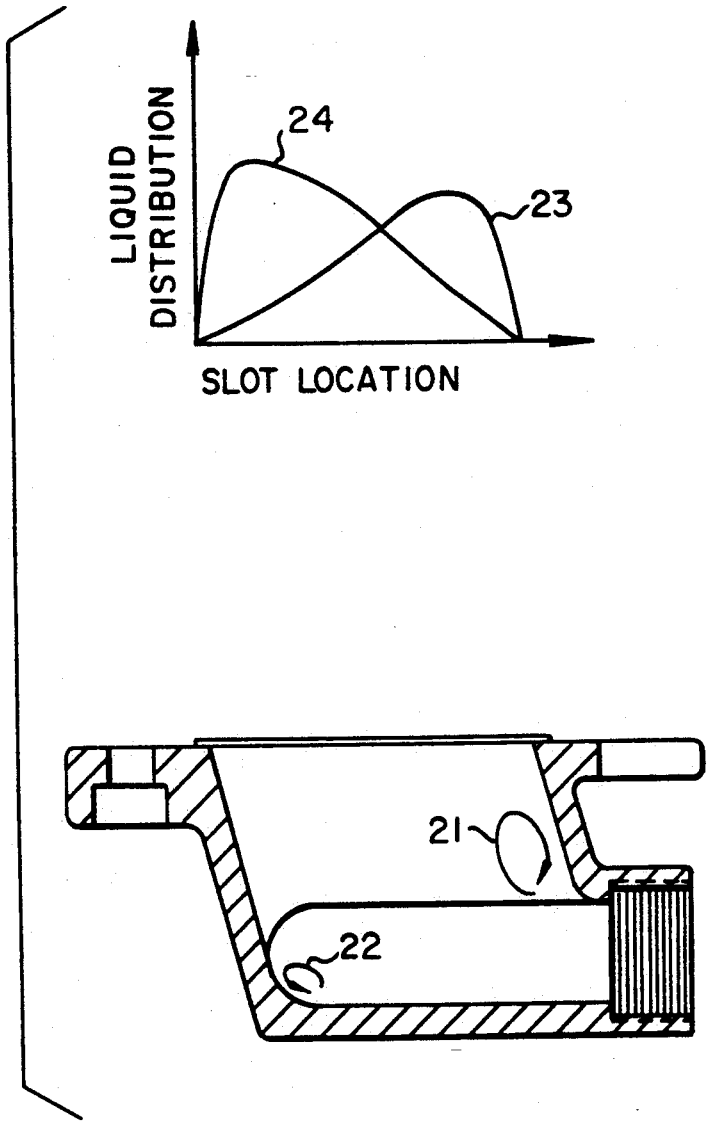
FIG. 4 PRIOR ART
FIG. 4 shows a prior art fluid distributor, the areas of recirculation within the distributor and the liquid distribution across the exit slot.

The inability for the existing liquid distributor to distribute liquid uniformly is an inherent characteristic of the design. Based on a mathematical model using a flow analysis computer program, FIDAP, which is commercially available from Fluid Dynamics International in Illinois, a flow analysis was conducted with the existing liquid distributor shown in FIGS. 1–4. The results show that at Reynolds number of 4, more liquid is distributed at the right hand side of slot 12, while at Reynolds number of 480, more liquid is being distributed toward the left hand side of slot 12. This is shown in FIG. 4; curve 24 represents the fluid distribution for high Reynolds numbers, and curve 23 represents a typical fluid distribution for low Reynolds numbers. This result is expected based on the fundamentals of fluid dynamics. At low Reynolds numbers the viscous effect of the liquid dominates the liquid flow, and the flow will be distributed closer to the liquid entrance, while at high Reynolds numbers, the liquid inertia dominates the liquid flow, and more liquid will be distributed towards the side of the slot, away from the liquid entrance. Table 1 shows the percentage of flow nonuniformity as a function of the Reynolds number.

TABLE 1

| Re | 4 | 480 |
|---|---|---|
| Flow Nonuniformity | 13% | 64% |

The present invention solves these problems by supplying liquid to a slotted distributor through two ports directed at each other at a position which is perpendicular to the long side of the distributor slot exit. The basic idea is shown in FIGS. 5, 6 and 11–13. More specifically, the invention has two ports 61 and 62, and a contoured slot 63 shown in FIG. 6. The ports 61 and 62 are directed against each other with their axes coincident to each other. Reference numbers 64–67 of FIG. 5 refer to the particular points and the line segments or contours refer to the dashed lines between the indicated points. The contoured slot has a smooth contour 64–65 at the entrance of the liquid with the bottom part flush with the ports. Contour 64–65 preferably is part of a circle. Segment 64–66 and 65–67 are tangent to contour 64–65 shown in FIG. 5. The slot opening is preferably constant and is attached to a coating device by conventional mechanical means (not shown).

Variations to the basic configurations presented in FIGS. 5, 6 and FIGS. 11–13 are apparent. The ports can be directed at each other with orientations different from that shown in FIGS. 5, 6 and 11–13. The shape of the ports need not be circular. Contour 64–65 need not be part of a circle, and the segments 64–66, 65–67 need not be straight lines. Furthermore, the slot does not have to have a constant width, a, between the inlet ports which may either expand or contract between the ports and the contoured slot.

Figure 7:
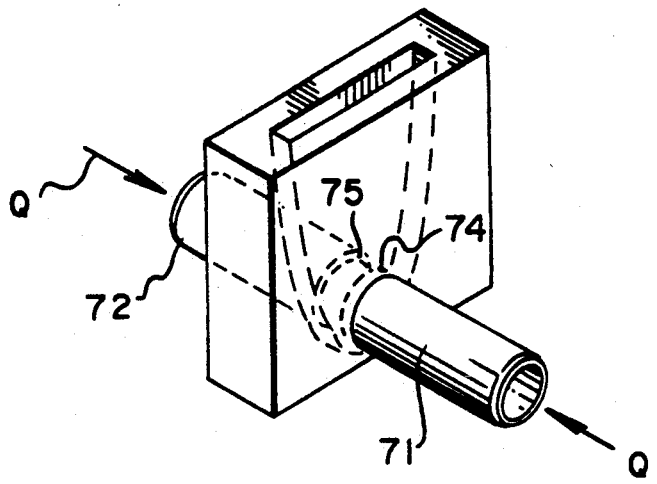
FIG. 7 shows a three dimensional view of the present invention.
Figure 8:
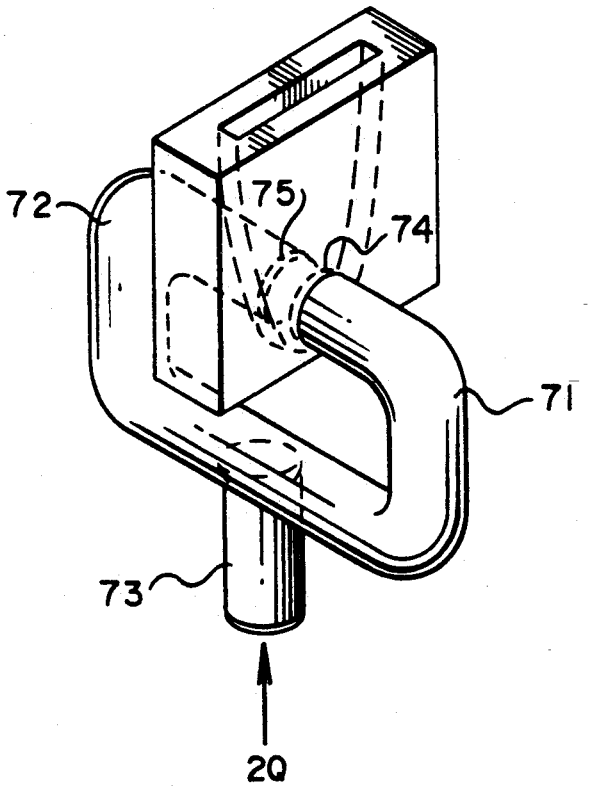
FIG. 8 shows an alternative embodiment of the present invention.

Liquid is supplied to the distribution device by an external delivering device with configurations shown in FIGS. 7–9 and 11–13. Each port can have its own delivery source or each port can have a common delivery source. The device can be constructed to deliver either the same liquid or two dissimilar liquids. The delivery device can be arranged in many conceivable ways. FIGS. 7–9 show some of the possible arrangements, where 71 and 72 are the delivery lines connected to the ports 74 and 75, respectively. FIGS. 8 and 9 show a common header 73 connected to the delivery lines 71 and 72. It is obvious that the orientation of the delivery lines 71, 72 and the common header 73 can be varied without affecting the performance of the liquid distributor.

EXAMPLES 1-5

Figure 5:
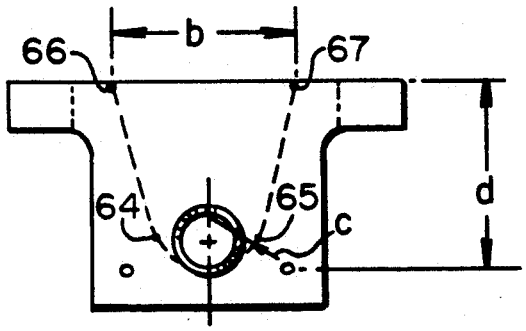
FIG. 5 shows a cross-sectional view of the fluid distributor of the present invention.
Figure 6:
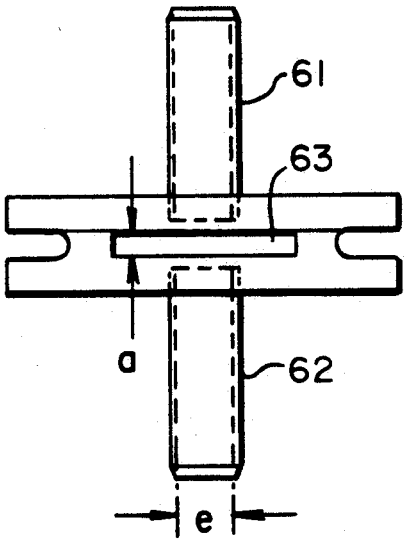
FIG. 6 shows a top view of the fluid distributor of the present invention.

To test the performance of the invention, five prototypes of the invention were made. FIGS. 5 and 6 show the schematics of the prototypes and Table 2 details the relative size of the important parameters with respect to the size of the slot opening, a, of 0.25 inch. The symbols a, b, c, d, and e are shown in FIGS. 5, 6 and 11–13 and are explained in more detail below.

TABLE 2

| Type | b/a | c/a | d/a | e/a |
|---|---|---|---|---|
| 1 | 8 | 2 | 6 | 1.75 |
| 2 | 8 | 2.5 | 6 | 1.75 |
| 3 | 8 | 2.48 | 8 | 2.48 |
| 4 | 8 | 2.48 | 8 | 2 |
| 5 | 8 | 3 | 8 | 2 |

Experiments conducted with glycerin and water mixtures show that no recirculation regions exist inside these liquid distribution devices for the range of Reynolds number covered in the experiment, as shown in Table 3.

TABLE 3

| Type | Re | Recirculation |
|---|---|---|
| 1 | 10-3000 | No |
| 2 | 10-3000 | No |
| 3 | 7-2100 | No |
| 4 | 8-2600 | No |
| 5 | 8-2600 | No |

The flow distribution capability of some of the prototypical devices has also been simulated with computer software FIDAP. The predicted results of flow nonuniformity are listed in Table 4. The nonuniformity is based on flow distribution at the exit of the slot, and "0.1 a" away from the wall. Typical distributions are shown in FIG. 10, where curve 51 is for low Reynolds number flow, and curve 52 is for high Reynolds number flow. As shown, the flow distribution is symmetrical with respect to the center of the liquid distribution device, and the inertia effect is not as detrimental to the flow distribution as in the case of the design shown in FIGS. 1–3.

TABLE 4

| Design | 3 | 3 | 4 | 4 |
|---|---|---|---|---|
| Re | 45 | 450 | 55 | 450 |
| Nonuniformity | 10% | 20% | 12% | 25% |

Figure 11:
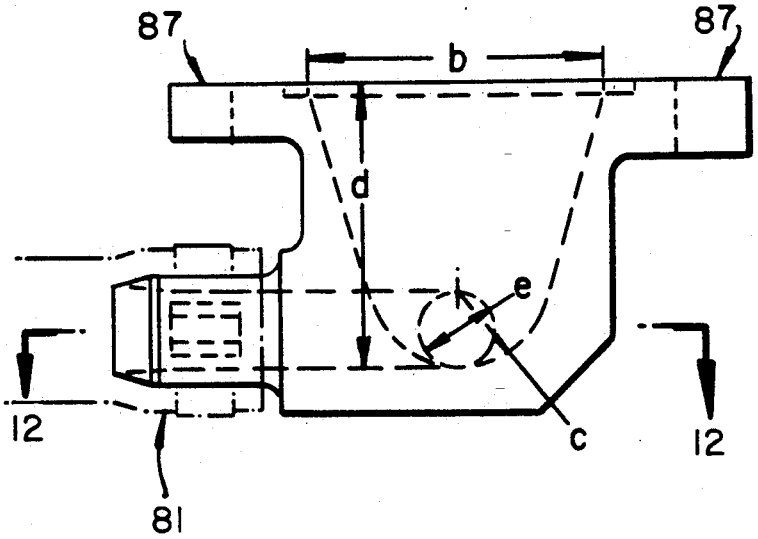
FIG. 11 shows a side view of the preferred embodiment of the present invention.
Figure 12:
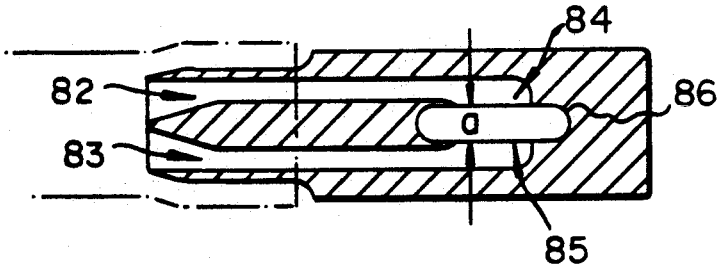
FIG. 12 shows a top cross-sectional view of the preferred embodiment of the present invention.
Figure 13:
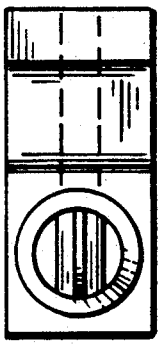
FIG. 13 shows an end view of the preferred embodiment of the present invention.

The preferred embodiment of the invention is shown in FIGS. 11–13. Liquid is supplied to the distribution device through inlet 81. Inlet 81 splits into two equal and parallel passages 82, and 83. Short passages 4 and 85 connect passages 82 and 83 to the contoured slot 86. They intersect passages 82 and 83, and the slot at a right angle. Slot 86 consists of an arc with two tangent lines. Bolt seat holes 87 are for the bolts used to connect the liquid distribution device to a coating device such as an extrusion die, bead coater, or curtain coater. The preferred size of the width, a, of slot 86 is 0.25 inch, and the preferred length, b, of the slot is 2 inches. The preferred radius of the arc, c, of the slot is 0.625 inch; the preferred distance, d, between the exit of the device and the bottom of the slot is 2.0 inches; and the preferred size, e, for passages 84 and 85 is 0.50 inches.

Flow visualizations conducted with the preferred embodiment have shown that no recirculation regions are observed over the range of Reynolds numbers, 8 to 3000, covered by the experiments. Due to the orientation of inlet 81, the flow field inside slot 86 becomes less symmetrical with respect to the center of the distributor as the Reynolds number increases. Nevertheless, the distribution capability of this preferred embodiment is expected to be better than the existing design shown in FIGS. 1-3, since the existing design is void of recirculation regions only below Reynolds number of 50.

It should be noted that, as shown by Tables 3 and 4, this design is robust and performs much better than the existing design over a wider range of geometric parameters and a wider range of flow conditions. Though not shown the other embodiments of the design are expected to perform well even when the geometry of the design varies from the preferred embodiment.

We claim:

1. A method of distributing fluids comprising:

providing a channel having an entrance end and an exit end formed by opposing spaced apart arcuate shaped walls terminating in a slot at the exit end, the slot having a length and a width, the length being greater than the width; and introducing fluid from the spaced apart walls near the entrance end of the channel in a direction perpendicular to the length such that the fluid impinges on itself within the channel and flows out the slot whereby recirculation zones within the channel are eliminated.

2. The method according to claim 1 wherein the fluid is a photographic emulsion.

3. A fluid distributor comprising:

a channel having an entrance end and an exit end formed by a pair of opposed arcuate sides spaced apart to form a slot at the exit end, the slot having a length and a width, the length being greater than the width;

a pair of opposed conduits positioned near the entrance end of said channel and perpendicular to the length such that when a fluid flows through the pair of opposed conduits the fluid impinges on itself within said channel and flows out the slot without creating recirculation zones within the channel.

4. The distributor according to claim 3 wherein the fluid is a photographic emulsion.

5. The distributor according to claim 3 wherein said conduits are positioned such that said conduits are directed away from the exit end.

6. The distributor according to claim 3 wherein said pair of opposed arcuate sides are circular at the entrance end and flush with said pair of opposed conduits and then extend at a tangent from the circular shape to the exit end.

7. The distributor according to claim 3 further comprising:

one or more fluid supply means for supplying the pair of opposed conduits with approximately equal flow rate of the fluid.

8. A fluid distributor for providing photographic emulsion to a coating hopper comprising:

a channel having an entrance end and an exit end formed by a pair of arcuate space apart walls which form a slot at the exit end, the slot having a length and width, the length being greater than the width, and a pair of opposed conduits perpendicular to the length positioned near the entrance end of said channel and transpiercing said pair of walls such that when fluid flows through the pair of conduits it impinges on itself within said channel and flows out the slot wherein recirculation zones within the channel are eliminated.

9. A fluid distributor comprising:

a housing having an exterior surface;

an elongated slot formed through said exterior surface, said slot having elongate side edges and end edges joining said side edges wherein said side edges are longer than said end edges;

a plenum formed within said housing said plenum being bounded by a first pair of walls extended into said housing from said side edges and a second pair of walls extended into said housing from said end edges, the walls of said first pair being arcuate and meeting opposite said slot; and a pair of opposed conduits opening into said plenum through the walls of said first pair, said conduits being perpendicular to the side edges.

10. The fluid distributor according to claim 9 further comprising:

a fluid supply means for supplying fluid to the pair of opposed conduits.

11. The fluid distributor according to claim 9 wherein the pair of opposed conduits are directed away from said slot.

* * * * *